United States Patent [19]

Lisiecki

[11] Patent Number: 4,971,243

[45] Date of Patent: Nov. 20, 1990

[54] COMPOSITE SINGLE SERVICE CONTAINER

[75] Inventor: Robert E. Lisiecki, West Bloomfield, Mich.

[73] Assignee: Elopak Systems A.G., Glattbruge, Switzerland

[21] Appl. No.: 454,936

[22] Filed: Dec. 22, 1989

[51] Int. Cl.[5] ..... B65D 5/32

[52] U.S. Cl. ..... 229/125.15; 229/23 R

[58] Field of Search ..... 229/23 R, 125.14, 125.15; 220/4 R, DIG. 25, 4 F

[56] References Cited

U.S. PATENT DOCUMENTS

| | | | |
|---|---|---|---|
| 1,121,947 | 12/1914 | Surmann | 229/23 R |
| 2,234,167 | 3/1941 | Hothersak | 229/23 R |
| 2,731,167 | 1/1956 | Moore | 220/DIG. 25 |
| 2,739,727 | 3/1956 | Fudge | 220/4 F |
| 2,741,390 | 4/1956 | Moore | 220/DIG. 25 |
| 3,184,140 | 5/1965 | Peterson | 229/23 R |
| 3,622,063 | 11/1971 | McVeigh | 229/23 R |
| 3,698,624 | 10/1972 | Stark | 229/23 R |
| 4,050,623 | 9/1977 | Vacchi | 229/23 R |
| 4,102,557 | 7/1978 | Lee et al. | 220/DIG. 25 |

*Primary Examiner*—Gary E. Elkins

*Attorney, Agent, or Firm*—John P. Moran

[57] ABSTRACT

A four-sided composite single service, liquid carrying container embodying two sealed together body components. One body component may consist of thermoplastic coated paperboard forming two oppositely disposed side panels and a bottom panel interconnecting same, while the other body component may consist of sheet plastic forming the other two oppositely disposed side panels and a top panel interconnecting same. A flange is formed around the entire edge portion of the sheet plastic component for being sealed under heat and pressure to the entire edge portion of the paperboard component. An opening and pouring device is formed on the top panel.

6 Claims, 1 Drawing Sheet

COMPOSITE SINGLE SERVICE CONTAINER

TECHNICAL FIELD

This invention relates generally to liquid-carrying containers having a composite construction and, more particularly, to such containers having combined U-shaped paperboard and sheet plastic components sealed together with no internal raw edges.

BACKGROUND ART

Heretofore, liquid-carrying containers have generally consisted of either a one-piece structure with either a gable or flat top closure, or, where two piece construction has been used, a four-sided body and integral bottom have been covered by a separate top cover.

Where pairs of sheet members of different physical character have been used to form the sides, top and bottom of a container, such container has generally either consisted of two corrugated board blanks, such as disclosed in McVeigh U.S. Pat. No. 3,622,063, or has been formed around a solid object which is to be packaged from a blank having a rigid bottom and two sides combined with a wrap-over cover sheet supplied from a roll or web, such as disclosed in Meyer et al. U.S. Pat. No. 3,935,943. Such containers are not capable of containing liquid products.

DISCLOSURE OF INVENTION

A general object of the invention is to provide an improved composite construction container of paperboard and sheet plastic.

Another object of the invention is to provide an improved composite construction container for carrying liquids.

A further object of the invention is to provide a liquid-carrying composite construction container with no internal raw edges.

Still another object of the invention is to provide a composite container comprising sealed together paperboard and sheet plastic, each of which includes two side panels and one of the top or bottom panels, and an opening means formed in the top panel.

These and other objects and advantages will become more apparent when reference is made to the following drawings and accompanying description.

BEST MODE OF CARRYING OUT THE INVENTION

Figure 1:
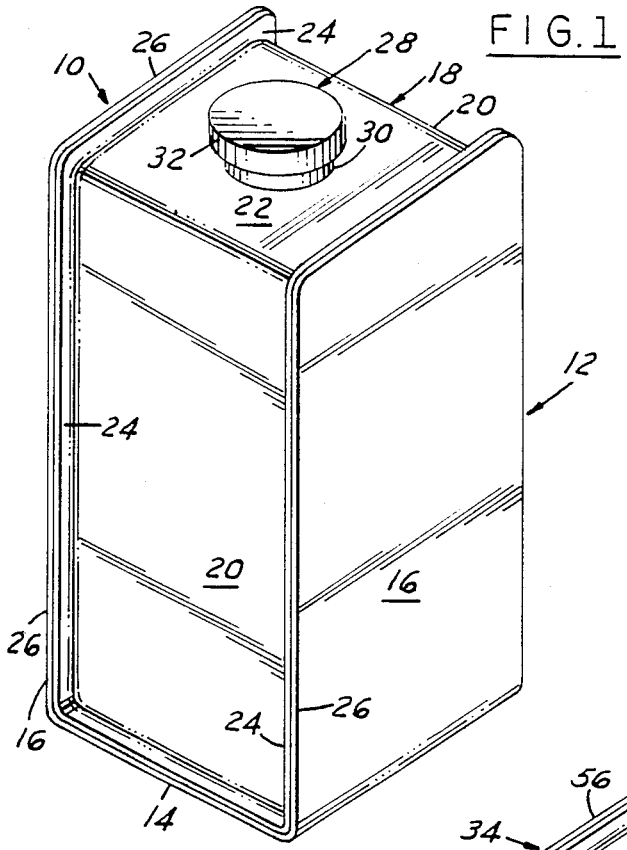
FIG. 1 is a perspective view of one embodiment of a container including the present invention.

Referring now to the drawings in greater detail, FIG. 1 illustrates a substantially square cross-section container 10 including a U-shaped thermoplastic-coated paperboard component 12 forming the bottom panel 14 and two side panels 16. A U-shaped sheet plastic component 18 forms the other two side panels 20 and the top panel 22. The sheet plastic portion 18 is formed to include an outwardly extending flange 24 along each edge thereof.

The flanges 24 and the adjacent edge portions 26 of the paperboard component 12 are heated and pressed together to become sealed on the outside of the container 10.

An opening and pouring device 28 is formed substantially in the center portion of the top panel 22. The device 28 may be simply a foil membrane (not shown) secured to the panel 22, or a cylindrical segment 30 either molded in place or added and secured to the panel 22, and having a suitable cap or cover 32 mounted thereon.

Figure 2:
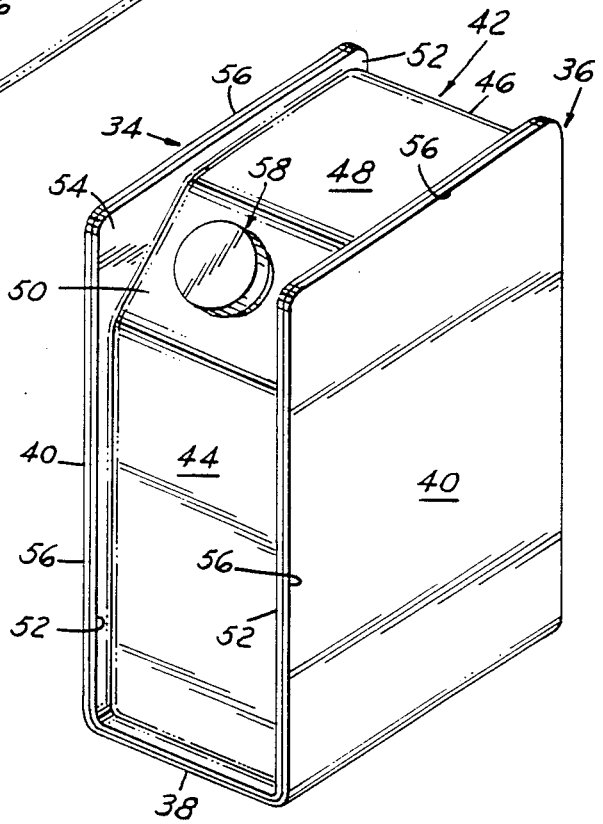
FIG. 2 is a perspective view of another embodiment of the invention.

Referring now to FIG. 2, there is illustrated a rectangular cross-section container 34 including a U-shaped thermoplastic-coated paperboard component 36 forming the bottom panel 38 and two side panels 40. A sheet plastic component 42 forms front and rear panels 44 and 46, respectively, and the top panel 48, with said top panel including an angled portion 50 formed so as to connect with the front panel 44.

As was the case for FIG. 1, outwardly extending flanges 52 are formed along each edge of the sheet plastic component 42, with a substantially triangular shaped flange 54 being formed adjacent the oppositely disposed edges of the angled portion 50. The flanges 52 and 54 and the adjacent edge portions 56 of the paperboard component 36 are heated and pressed together to become sealed on the outside of the container 34. An opening and pouring device 58, which may be similar to the device 28 of the FIG. 1 structure is formed substantially at the center of the angled portion 50 as a more conveniently located pouring opening and providing better venting characteristics during pouring.

INDUSTRIAL APPLICABILITY

It should be apparent that, in view of the outside sealing of the container components, there are no internal raw edges to cause wicking into the paperboard of the liquid contents into the paperboard.

It should also be apparent that the two basic container components may consist of any two materials having heat sealing compatibility.

It should be further apparent that the angled top portion and associated pouring mechanism is adaptable to the square cross-section container, as well as to the rectangular cross-section container.

It should be still further apparent that, with the inclusion of the paperboard component, any desired graphics may be included thereon in the manner usually found on gable top paperboard containers for liquids such as milk and juices.

While but two embodiments of the invention have been shown and described, other modifications thereof are possible within the scope of the following claims.

The embodiments of the invention in which an exclusive property or privilege is claimed are defined as follows:

1. A four-sided liquid-carrying container comprising two body components having heat sealing compatibility, wherein one body component forms two oppositely disposed side panels and an interconnecting bottom panel, and the other body component forms the other two side panels and an interconnecting top panel;

an outwardly extending flange formed around the entire edge portion of one of said two body portions adapted to being sealed by heat and pressure to the entire edge portion of said other body component; and opening and pouring means formed in said top panel.

2. The four-sided liquid carrying container described in claim 1, wherein said one body component consists of thermoplastic coated paperboard, and said other body component consists of sheet plastic.

3. The four-sided liquid carrying container described in claim 1, wherein said opening and pouring means includes a cylindrical segment formed in said top panel, and a cap mounted on said cylindrical segment.

4. The four-sided liquid carrying container described in claim 1, wherein said two sealed-together body components have a substantially square cross-section.

5. The four-sided liquid carrying container described in claim 1, wherein said two sealed-together body components have a rectangular cross-section.

6. The four-sided liquid carrying container described in claim 1, wherein said top panel includes an angled portion connecting with one of the side panels, said opening and pouring means being formed in said angled portion.

* * * * *